United States Patent [19]

Matsushita et al.

[11] Patent Number: 4,756,950

[45] Date of Patent: Jul. 12, 1988

[54] GRADATION RECORDING HEAT-TRANSFER SHEET

[75] Inventors: Toshihiko Matsushita, Tokyo; Sadao Morishita, Ibaraki; Mikiya Sekine, Warabi; Kenji Yabuta, Takasago, all of Japan

[73] Assignee: Mitsubishi Paper Mills, Ltd., Tokyo, Japan

[21] Appl. No.: 841,607

[22] Filed: Mar. 20, 1986

[30] Foreign Application Priority Data

| | | | |
|---|---|---|---|
| Mar. 23, 1985 | [JP] | Japan | 60-58947 |
| Apr. 20, 1985 | [JP] | Japan | 60-85203 |
| May 10, 1985 | [JP] | Japan | 60-99059 |

[51] Int. Cl.[4] ..... B41M 5/025; B41M 5/26

[52] U.S. Cl. ..... 428/195; 428/207; 428/211; 428/480; 428/481; 428/484; 428/488.1; 428/913; 428/914

[58] Field of Search ..... 428/195, 207, 484, 488.1, 428/488.4, 913, 914, 211, 480, 481

[56] References Cited

U.S. PATENT DOCUMENTS

| | | | |
|---|---|---|---|
| 4,510,206 | 4/1985 | Shuman | 428/914 |
| 4,559,055 | 7/1984 | Asakura et al. | 428/914 |
| 4,612,243 | 9/1986 | Shimazaki et al. | 428/914 |

*Primary Examiner*—Bruce H. Hess

*Attorney, Agent, or Firm*—Cushman, Darby & Cushman

[57] ABSTRACT

A heat-transfer recording sheet comprising a support and, coated thereon, a heat-meltable ink layer acquires the ability of reproducing the gradation when said ink layer contains a saturated linear polyester or gallic acid.

8 Claims, No Drawings

GRADATION RECORDING HEAT-TRANSFER SHEET

BACKGROUND OF THE INVENTION

1. Field of the Invention

This invention relates to a heat-transfer sheet capable of expressing a gradation in heat sensitive, heat-transfer recording.

2. Description of the Prior Art

As heat-transfer systems, there have previously been known a heat-sublimation transfer process which comprises forming on a support an ink layer containing a heat-sublimable dye and allowing the dye to sublime by heating and transfer onto an image receiving sheet, thereby to perform the recording; and a hot-melt transfer process which comprises forming on a support a heat-meltable ink layer containing a colored dye or pigment and heating the ink layer to allow the molten ink to transfer onto an image receiving sheet, thereby to perform the recording (hereinafter a support carrying an ink layer is sometimes referred to as donor sheet). The heat-sublimation transfer process is characterized by an excellent gradation of the recorded image, because it is formed by the condensation of the vaporized dye, and the process is looked upon as promising for full color recording. Inventions relating to an improvement in the dyeability of image receiving sheets have been disclosed in Japanese Patent Application "Kokai" (Laid-open) Nos. 91,296/82, 107,885/82, 137,191/82, 49,495/84.

The heat-sublimation transfer process, however, has the disadvantage of a low recording speed owing to a high sublimation temperature of the dye which also requires prolonged heating. Although a dye which sublimes at a lower temperature may be used, such a dye produces a transferred image of low preservability due to resublimation of the dye. For this reason, various attempts have been made to improve the gradation of the image obtained by the hot-melt transfer process which has a higher recording speed and has an improved image preservability.

For instance, Japanese Patent Application "Kokai" (Laid-open) No. 56,295/82 discloses a heat-transfer sheet comprising a heat-meltable ink layer (A) provided on a support and an overcoating of a heat-meltable ink layer (B) which has a melting point lower than that of (A) which is disposed in a pattern of dots isolated from one another. This sheet reproduces a half-tone by the modulation of the amount of transferred ink by heating. Japanese Patent Application "Kokai" (Laid-open) No. 64,391/84 discloses a heat-transfer sheet comprising a support and, coated thereon successively, a layer containing an image-forming substance capable of forming an image by heating and an image-receiving layer capable of transferring the image by heating to a material which receives the transferred image, whereby the heat-transfer of the image-forming substance to the image-receiving material is controlled.

The above-mentioned two patent applications intend to reproduce the gradation by modifying the structure of ink layer coated on a support. Such a structure requires double-coating to obtain a donor sheet, resulting in an increase in manufacturing costs.

Conventional single-layer donor sheets are obtained by coating a support, by gravure or flexographic printing, with a hot-melt ink prepared by melting colored dyes or pigments, binders, waves, and other additives.

Since the waxes used in a donor sheet have a large latent heat of fusion as required for a regenerator, it is difficult to specifically reproduce the gradation of the image areas corresponding to low thermal energies. As a consequence, when the heat-transfer impression is made on a plain paper or coated paper by using such a donor sheet and a heat-sensitive facsimile or thermal printer, there is obtained a high-contrast on-off binary record without a density gradation even if the printer is provided with 16 density gradients. Therefore, efforts are being made to reproduce the gradation in a complicated manner by using a number of donor sheets which differ in transfer density and making plural superimposed impressions; or by using, in addition to said superimposed impressions, the technique of dot gradation by controlling the number of dots in the printer matrix. Such a complicated printing system has the disadvantages of high cost of the donor sheets and low printing speed.

SUMMARY OF THE INVENTION

An object of this invention, therefore, is to provide a heat-transfer sheet capable of reproducing the gradation at low cost.

The above object is achieved by a gradation recording heat-transfer sheet comprising a support and, provided thereon, a heat-meltable ink layer containing a heat-meltable dye, which is characterized by being such that said heat-meltable ink layer further contains a saturated linear polyester; said heat-meltable dye has a melting point of 60°–120° C.; said heat-meltable dye content of said heat-meltable ink layer is 41–73% by weight in terms of solids based on the total weight of the heat-meltable ink layer; and the ratio of said heat-meltable dye to said saturated linear polyester is 0.7–2.6:1. This gradation recording heat-transfer sheet is hereinafter referred to as the heat-transfer sheet of the present first invention.

The above object is also achieved by a gradation recording heat-transfer sheet comprising a support and, provided thereon, a heat-meltable ink layer containing a colored dye or pigment, a binder, and a wax, which is characterized by being such that said heat-meltable ink layer further contains gallic acid and/or a derivative thereof in an amount of 5–50% by weight in terms of solids based on the total weight of the heat-meltable ink layer. This gradation recording heat-transfer sheet is hereinafter referred to as the heat-transfer sheet of the present second invention.

DESCRIPTION OF THE PREFERRED EMBODIMENTS (1) First, the heat-transfer sheet of the present first invention is described in detail.

The first feature of the heat-transfer sheet of the first invention is that the heat-meltable ink layer, which is provided on a support and contains a heat-meltable dye, further contains a saturated linear polyester. The present inventors found that the saturated linear polyester resin is an excellent binder for use in the gradation recording heat-transfer sheet, because when softened by heating, the resin shows excellent adhesion to all of the supports including capacitor tissue paper (condenser paper), polyester film, polyamide film, polyimide film, and the like which are narrow in thickness, excellent in heat conductivity and heat resistance, and are now being used as a support in common heat-transfer sheets.

No matter how excellent the cold adhesion may be, a binder exhibiting poor adhesion to the support at high temperatures is unsuitable for the reproduction of gradation by the heat-transfer of a molten dye to an image receiving sheet. The saturated linear polyester exhibits an excellent adhesion when softened at elevated temperatures and, accordingly, contributes to the reproduction of gradation.

The saturated linear polyester resin used in the first invention is formed by the polycondensation between a dioxy compound (or alkylene oxide) and a dibasic acid and has a structure in which the atoms in the main chain are linked in a straight chain. As examples of dibasic acids used in preparing such a polyester, mention may be made of adipic acid, azelaic acid, sebacic acid, and phthalic acid. The dioxy compounds (or alkylene oxide) include ethylene glycol, ethylene oxide, and 1,4-cyclohexanedimethanol. The molecular weight of the polyester resin is generally 5,000 to 25,000. Commercial produces such as, for example, Vylon-200, 300, 600, 630, 5500, GM-400, and GM-900 (produced by Toyobo Co.) can be used.

The gradation can be controlled by the melting point of the heat-meltable dye. However, if the melting point of the dye is below 60° C., the transfer density becomes too high and the phenomenon of blocking tends to take place, whereas if it exceeds 120° C., the transfer density becomes undesirably low. In the present first invention, the suitable range of the melting point of dyes is from 60° to 120° C. Although favorable to the increase in transfer density, the addition of binders having a melting point as low as 100° C. or below is undesirable for the reason of adverse effect on the gradation as described above.

The heat-meltable dye content of the heat-meltable ink layer is also an important factor. If the content exceeds 73% by weight, the transfer density exhibits rapid increase owing to insufficient adhesion of the binder to the support at elevated temperatures, thereby making it difficult to record the gradation. If the dye content is below 41% by weight, the transfer density becomes insufficient. Therefore, the suitable range of the dye content is from 41 to 73% by weight. In this respect, the present first invention is different in objects and constitution from that of the prior patent application, Japanese Patent Publication No. 37,237/84. This patent discloses a heat-transfer recording medium comprising two types of binders which differ in softening point, glass transition temperature (Tg), and breaking elongation, and 2 to 40% by weight of coloring agents. Since this patent does is not concerned with gradation recording, use is made of binders which are lower in high-temperature adhesiveness to the support than the binder used in the present first invention and the coloring agent content of the ink layer is also lower.

In the case of gradation recording by the heat-transfer process, it is necessary that the heat-meltable dye be transferred to an image receiving sheet in accordance with the level of heat energy distributed in a broad range. For this purpose, a binder having an excellent adhesiveness to the support at elevated temperatures must be used and, as a consequence, a dye content of the ink layer of 2 to 40% by weight is insufficient to secure a satisfactory transfer density.

The heat-meltable dye suitable for use according to the first invention is any of those having a melting point of 60° to 120° C. As examples, several of the dyes described in Color Index are shown below.

| No. | Color Index No. | Melting point (°C.) |
|---|---|---|
| 1 | CI-41000B (CI-Solvent Yellow 34) | 120 |
| 2 | CI-Solvent Orange 12 | 95–103 |
| 3 | CI-12005 (CI-Solvent Red 2) | 85 |
| 4 | CI-Solvent Red 16 | 71–72.5 |
| 5 | CI-26125 (CI-Solvent Red 27) | 108–120 |
| 6 | CI-42563B (CI-Solvent Blue 2) | 110 |
| 7 | CI-42595B (CI-Solvent Blue 5) | 90 |
| 8 | CI-Solvent Blue 19 | 75–78 |
| 9 | CI-Solvent Brown 13 | 108 |
| 10 | CI-Solvent Black 9 | 110 |
| 11 | CI-11160 (CI-Solvent Yellow 3) | 110 |
| 12 | CI-11380 (CI-Solvent Yellow 5) | 104 |
| 13 | CI-11850 (CI-Solvent Yellow 11) | 107–108 |
| 14 | CI-11860 (CI-Solvent Yellow 12) | 97 |
| 15 | CI-11870 (CI-Solvent Yellow 8) | 103–104 |
| 16 | CI-37210 (CI-Azoic Diazo Component 4) | 100 |
| 17 | CI-37120 (CI-Azoic Diazo Component 10) | 84 |

According to the present first invention, the ratio of a heat-meltable dye to a saturated linear polyester is also important and should be in the range of 0.7–2.6 to 1. If the ratio is below 0.7:1, the density of the transferred image is low, whereas if the ratio exceeds 2.6:1, the density of the transferred image is too high to obtain the gradation expression. When the ratio is 0.7–26:1, as appropriate density and gradation expression can be achieved.

According to the present first invention, the reproducibility of the gradation of the heat-transfer sheet is fundamentally controllable by the melting point of heat-meltable dye, the dye content of the heat-meltable ink layer, and the ratio of the heat-meltable dye to a saturated linear polyester binder.

The heat-meltable ink layer may further contain gallic acid and/or a derivative thereof, and an acetylene glycol. If necessary, an organic compound compatible with the heat-meltable dye can be added to the heated ink composition or to the heat-meltable dye to decrease the melting point of the latter.

According to the first invention, the heat-meltable ink layer is applied to the support at a coverage of 2 to 10 g/m$^2$. For the purpose of improving the heat resistance, solvent resistance, and other characteristics, there may be added cellulose nitrate, vinyl chloride resin, phenol resin, isocyanate, methoxymelamine, xylene resin, epoxy resin, chlorinated rubber, polyvinylidene chloride, succarose benzoate, oligostyrene, polyketone, chlorinated polypropylene, allylsulfonamide, triazineformaldehyde, and plasticizer such as DBP, BBP and TCP. These substances and the ink composition are mixed by melting together.

Provided that the ink composition contains a saturated linear polyester resin as major binder, it is possible to add other adhesive resins in an amount not exceeding 40% by weight based on total binder material. Examples of such resins include polyvinyl acetate, polyvinylbutyral, polyvinyl alcohol, vinyl chloride-vinyl acetate copolymer, polyacrylic esters, polymethacrylic esters, ethylcellulose, polystyrene, polyethylene, ethylene-vinyl acetate copolymer, and polyamides.

In applying the heat-meltable ink composition to the support by coating or printing, other additives than the binder materials and heat-meltable dyes, such as surface active agents, dispersants, antistatics, antioxidants, and UV absorbers can be added to the composition. It is also possible to add, in addition to the above-mentioned binders and heat-meltable dyes, those dyes, pigments, binders and waxes which are used as essential constituents in the heat-transfers sheets according to the present second invention.

As supports, thin papers such as capacitor paper (condenser paper), typewriter paper, and tracing paper; synthetic papers; cellophane; and synthetic resin films such as polyester film, polyimide film, polyethylene film, polycarbonate film, polystrene film, and "Teflon" film may be used. These support materials are used as such or after heat-resisting treatment in order to prevent adhesion to the thermal head. The heat-resisting treatment is performed by coating the side of the support material to become in contact with the thermal head, that is, the side opposite to the heat-transfer layer side, with a silicone resin, epoxy resin, melamine resin, phenol resin, fluorocarbon resin, polyimide resin, cellulose nitrate or the like.

The coating composition is applied by known coaters such as air-knife coater, roll coater, blade coater, and bar coater or by known printing presses used in gravure printing or flexography. In applying the composition, solvents are generally used. As examples of suitable solvents, mention may be made of methyl ethyl ketone, acetone, ethyl acetate, tetrahydrofuran, dichloromethane, dichloroethane, toluene, methanol, and ethanol. The hot-melt application is also possible by using properly selected linear polyester resins such as, for example, GM-400 and GM-900 (Toyobo Co.). The full color image is obtained by using inks of at least yellow, magenta, and cyan colors or at least yellow, magenta, cyan, and black colors and applying each ink to the same support by printing locally in line serial, area serial, or dot serial manner.

(2) Next, the present second invention is described in detail.

The present second invention is characterized by being such that the heat-meltable ink layer, which is provided on a support and contains a colored dye or pigment, a binder, and a wax, further contains gallic acid and/or a derivative thereof.

As the derivative of gallic acid, at least one member selected from methyl gallate, ethyl gallate, propyl gallate, isoamyl gallate, octyl gallate, lauryl gallate, stearyl gallate, trimethoxygallic acid, methyl trimethoxygallate, gallic acid 3-methyl ether, gallic acid 4-methyl ether, gallic acid 3,4-dimethyl ether, and gallic acid 3,5-dimethyl ether; preferably at least one member selected from alkyl gallates including methyl gallate, ethyl gallate, propyl gallate, isoamyl gallate, octyl gallate, lauryl gallate, and stearyl gallate.

According to the second invention, the heat-meltable ink layer contains 5 to 50% by weight of gallic acid and/or a derivative thereof in terms of solids based on total solids of the ink layer. If the content of gallic acid and/or a derivative thereof is below 5% by weight, it is difficult to obtain gradation expression, whereas if it exceeds 50% by weight, the density of transferred image is low. When the content is in the range of from 5 to 50% by weight, appropriate density and gradation expression can be realized. The preferred range is from 10 to 30% by weight.

Further addition of acetylene glycols to the heat-meltable ink of the second invention brings about advantages of further improvement of the ink in the dispersion of dyes or pigments in other constituents and in the adhesion of ink layer to the support. The acetylene glycol suitable for use is at least one member selected from 2,4,7,9-tetramethyl-3-decyne-4,7-diol, an ethylene oxide adduct thereof, and 3,6-dimethyl-4-octyne-3,6-diol. The acetylene glycol is used in an amount of 0.1 to 20, preferably 0.5 to 10, % by weight of the solids contained in the heat-meltable ink layer.

The same polyester as used in the heat-transfer sheet of the first invention can also be used for the same purpose.

The gradation recording heat-transfer sheet of the second invention is obtained by the single coating of the heat-meltable ink on a support to produce an image of sufficient density gradation. A color image exhibiting sufficient gradation can be obtained by using heat-meltable inks in at least yellow, magenta, and cyan colors or in at least yellow, magenta, cyan, and black colors and locally coating the support with each ink to produce a heat-transfer recording sheet. Although the exact reason for the reproduction of density gradient by the present heat-transfer sheet is yet to be elucidated, it seems that when the energy from the thermal head is low, the ink transfer is retarded by the presence of gallic acid and/or a derivative thereof having a high melting point and with the increase in the energy level, the ink transfer is gradually increased in proportion to the gradual increase in the energy level, thereby to produce gradation in the density, whereas in the conventional heat-transfer recording sheet, the heat-meltable ink layer contains a wax responsible to the ink-transfer and the ink is completely transferred to the image-receiving sheet when the imparted energy reached a certain level. In the case of the present heat-transfer sheet, upon magnification of the heat-meltable ink layer comprising the constituents according to the second invention, it is observed that the ink is dispersed as fine particles on the support and each particle seems to transfer independently in response to the energy of thermal head, thus contributing also to the gradation recording.

The type, quantity, and melting point of each essential constituent of the ink layer, that is, binder, wax, and dye or pigment have little effect.

Regarding the waxes for example, those having a melting point of 50° to 200° C., particularly 60° to 150° C., give good results. If the melting point is below 50° C., the wax is too sensitive to the heat and no density gradation is produced when heat-transferred, even if it is dispersed in fine particles in the ink layer. Conversely, if the melting point is above 200° C., the thermal head requires a high energy and the rate of heat-transfer becomes decreased, making the sheet unsuitable for practical use.

The waves shown belows are typical and not limited examples.

Vegetable waxes: rice wax, Japan wax, candelilla wax, and carnauba wax.

Animal wax: lanolin, beeswax, and shellac wax.

Mineral wax: montan wax.

Synthetic wax: paraffin wax, microcrystalline wax, oxidized paraffin wax, chlorinated paraffin wax, ricinolic acid amide, lauric acid amide, erucic acid amide, palmitic acid amide, oleic acid amide, 12-hydroxystearic acid amide, distearyl ketone, and ethylenebisstearic acid amide.

Metal soap: sodium stearate, sodium palmitate, potassium laurate, potassium myristate, calcium stearate, zinc stearate, aluminum stearate, magnesium stearate, lead stearate, and barium dibasic stearate.

Higher fatty acid: palmitic aid and stearic acid.

Higher alcohol: palmityl alcohol, stearyl alcohol, and ceryl alcohol.

Synthetic polyalcohol: polyethylene glycol and polypropylene glycol.

As for the dyes and pigments, any of the water-soluble dyes, oil-soluble dyes, disperse dyes, and solvent-insoluble organic pigments can be used without paying attention to the quality of gradation, proper selection being dependent upon the method of application. The water-soluble dyes are preferaby applied as solutions in water or solvents. Those soluble in organic solvents are applied as such solutions. Soluble dyes and disperse dyes can be applied as hot melt. The particle size of dyes or pigments is preferably about 1$\mu$ or less to exclude coarse grains from the transferred image. Sublimable dyes can also be used but the advantages can not be sufficiently manifested in the present case.

Examples of individual dyes and pigments are shown below for the purpose of illustration and not of limitation. They are used each alone or in mixtures, Color Index No. is shown in parentheses.

The water-soluble dyes include nitroso dyes, azo dyes (mono-, bis-, tris-, and tetrakis-azo dyes), stilbeneazo dyes, ketoimine (diphenylmethane) dyes, triphenylmethane dyes, xanthene dyes, acridine dyes, quinoline dyes, methine dyes, polymethyine dyes, thiazole dyes, indamine dyes, azine dyes, thiazine dyes, oxyketone dyes, anthraquinone dyes, and phthalocyanine dyes. Examples are Mordant Green 4 (10005) for nitroso dyes, Direct Red 28 (22120) for azo dyes, Direct Orange 71 (40205) for stilbeneazo dyes, Basic Yellow 2 (41000) for ketoimine dyes, Basic Blue 1 (42025) for triphenylmethane dyes, Acid Red 52 (45100) for xanthene dyes, Basic Orange 23 (46075) for acridine dyes, Acid yellow 2 (47010) for quinoline dyes, Direct Yellow 59 (49000) for methine dyes, Acid Blue 59 (50315) for azine dyes, Mordant Blue 10 (51030) for oxazine dyes, Basic Blue 9 (52015) for thiazine dyes, Acid Blue 45 (63010) for anthraquinone dyes, and Direct Blue 86 (74180) for phthalocyanine dyes.

Oil-soluble dyes include azo dyes, azo metal complex dyes, anthraquinone dyes, and phthalocyanine dyes. Examples are Solvent Yellow 2 (11020), Solvent Orange 1 (11920), Solvent Red 24 (26105), and Solvent Brown 3 (11360) for azo dyes, Solvent Yellow 19 (13900A), Solvent Orange 5 (18745A), Solvent Red 9 (12715), Solvent Brown 37 and Solvent Black 123 (12195) for azo metal complex dyes, Solvent Violet 13 (60725), Solvent Blue 11 (61525), and Solvent Green 3 (61565) for anthraquinone dyes, and Solvent Blue 25 (74350) for phthalocyanine dyes.

Disperse dyes include aminoazo or aminoanthraquinone dyes and nitroarylamine dyes. Examples are Disperse Yellow 3 (11855), Disperse Orange 3 (11005), Disperse Red 1 (11110), Disperse Violet 24 (11200), and Disperse Blue 44 for aminoazo dyes, Disperse Orange 11 (60700), Disperse Red 4 (60755), Disperse Violet 1 (61100), and Disperse Blue 3 (61505) for aminoanthraquinone dyes, and Disperse Yellow 1 (10345) and Disperse Yellow 42 (10338) for nitroarylamine dyes.

Pigments include azo pigments (monoazo, bisazo, condensed azo pigments), dye lake pigments (acid dye lake, basic dye lake, mordant dye lake pigments), nitro pigments, nitroso pigments, phthalocyanine pigments, and high grade pigments (vat dye pigments, metal complex pigments, perylene pigments, isoindolinone pigments, quinacridone pigments). Examples are Hansa Yellow G (11680), Hansa Yellow R (12710), Pyrazolone Red B (21120), Permanent Red R (12085), Lake Red C (15585), Brilliant Carmine 6B (15850), and Permanent Carmine FB (12490) for monoazo pigments; Benzidine Yellow GR (21100), and Permanent Yellow NCR (20040) for bisazo pigments; chromophthal Yellow and Chromophthal Red for condensed azo pigments; Quinoline Yellow Lake (47005), Eosine Lake (45380), and Alkali Blue Lake (42750A, 42770A) for acid dye lake pigments; Rhodamine Lake B (45170), Methyl Violet Lake (42535), Victoria Blue Lake (44045), and Malachite Green Lake (42000) for basic dye lake pigments; Alizaline Lake (58000) for mordant dye lake pigments; Naphthol Yellow S (10316) for nitro pigments; Pigment Green B (10006) and Naphthol Green B (10020) for nitroso pigments; Metal-free Phthalocyanine Blue (74100), Phthalocyanine Blue (74160), and phthalocyanine Green (74260) for phthalocyanine pigments; Anthrapyrimidine Yellow (68420), Indanthrene Brilliant Orange GK (59305), Indanthrene Blue RS (69800), and Thioindigo Red B (73300) for vat dye pigments; Nickel Azo Yellow (12775) for metal complex pigments; Perylene Red (71140) and Perylene Scarlet (71137) for perylene pigments; Isoindoline Yellow for isoindolinone pigments; Quinacridone Red Y (46500) and Quinacridone Magenta (73915) for Quinacridone pigments; and Carbon Black (77265) for black pigments.

As binders, use may be made of either water-soluble types or water-insoluble types. Water-soluble types are used in aqueous or nonaqueous coating. Water-insoluble types are used in solvent coating or hot melt coating. Typical examples of binders are given below for the purpose of illustration and not of limitation. The binders are used each alone or in combinations.

Polyvinyl alcohol, methylcellulose, gelatin, hydroxyethylcellulose, carboxymethylcellulose, gum arabic, starch and derivatives thereof, casein, polyvinylpyrrolidone, butyral resin, ethylene-ethyl acrylate copolymer, styrene-butadiene copolymer, vinyl acetate resin, vinyl acetate copolymers, acrylic resins, methyl methacrylate resin, styrene-acrylonitrile resin, ethylene-vinyl acetate copolymer, polyester resins, and petroleum resin.

The proportions of main constituents in the heat-meltable ink layer are preferably 0.5–40, most preferably 1–25, % by weight of a dye or pigment, preferably 10–70, most preferably 20–60, % by weight of a wax, and preferably 5–60, most preferably 10–50, % by weight of a binder. In the heat-transfer sheet of the present second invention, the main constituents of the heat-meltable ink layer are, as mentioned above, gallic acid and/or a derivative thereof, a colored dye or pigment, a binder, and a wax. In providing said ink layer on a support by coating or printing, other additives such as, for example, surface active agents, dispersing agents, antistatic agents, antioxidants, UV absorbers, etc. can be added.

As the supports, use may be made of thin papers such as capacitor paper (condenser paper), typewriter paper, and tracing paper; synthetic papers; cellophane; synthetic resin films such as polyester film, polyimide film, polyethylene film, polycarbonate film, polystyrene film, and "Teflon" film. These support materials are used each as such or after heat-resisting treatment in order not to stick to the thermal head.

The heat-meltable coating composition is applied by means of known coaters such as hot-melt coater, air-knife coater, roll coater, blade-coater, and bar coater or by known printing presses used in flexography or gravure printing.

The full color image is obtained by using inks of at least yellow, magnenta, and cyan or at least yellow, magenta, cyan, and black colors and applying each ink to the same support by locally printing in the serial, area serial, or dot serial manner.

When the ink layer is to be provided from a solution, suitable use can be made of common solvents such as methanol, ethyanol, isopropyl alcohol, toluene, methyl ethyl ketone, acetone, and ethyl acetate.

The invention is illustrated in detail below with reference to Examples, but the invention is not limited thereto.

EXAMPLE 1 (the first invention) and COMPARATIVE EXAMPLE 1

A saturated linear polyester (Vylon 630, Toyobo Co.), used as binder, and a heat-meltable dye (SOT-Blue G, m.p. 74°–75° C., Hodogaya Chemical Co.) were mixed in ratios of 1:1, 1:0.7, and 1:2.6 and each mixture was dissolved in a toluene-methyl ethyl ketone (8:2) mixture. Each solution was coated, by means of Meyer bar, on a polyester film, 6μ in thickness, which had been subjected to heat-resisting treatment, at a coverage of 3.5 g/m$^2$ on dry basis to obtain a heat-transfer sheet (donor sheet). The ink-bearing surface of the donor sheet was brought into contact with a plain paper (TTR-T, tradename, a receiving sheet for the heat-transfer recording produced by Mitsubishi Paper Mills Co.). Thermal impression was made on the back side of the donor sheet by means of a facsimile tester (Matsushita Electronic Parts Co.) at 16.0 V, while the pulse width having been varied from 1.0 to 3.0 milliseconds at an interval of 0.2 millisecond. The density of the transferred image was tested by means of a photodensitometer (Macbeth RD 514).

For comparison, heat-transfer recording sheets prepared by varying the ratio between the binder and the heat-meltable dye and those prepared by using various binders were tested. The results of tests for the comparative samples together with the results obtained by using various binders were shown in Table 1.

Binders used in Comparative Examples 1-3 to 1-9 were as shown in the following table.

| Comparative Example No. | Tradename | Composition | Produced by |
|---|---|---|---|
| 1-3 | N-14 | Ethylcellulose | Hercules |
| 1-4 | Esleck BL-2 | Polyvinyl-butyral | Sekisui |
| 1-5 | IOL | PVA (low saponification) | Unitika |
| 1-6 | EV-40 | Ethylene-vinyl acetate resin | Mitsui-DuPont Chemical |
| 1-7 | Araster-700 | Styrene-maleic acid half ester | Arakawa Chemical |
| 1-8 | Placize L-539 | Acrylate ester | Goo Chemical |
| 1-9 | Phthalkid 355-50 | Alkyd resin | Hitachi Chemical |

As is apparent from Table 1, some types of binders having good adherence to the support at ordinary temperatures exhibited a decline in adherence when heated and, as a consequence, unmelted portions of the ink layer together with other portions of ink which were melted in proportion to the given heat energy were transferred to the image-receiving sheet. There are other types of resins such as ethylene-vinyl acetate resin which, when heated, retained an excellent adherence to the support but exhibited so high a stickiness that the ink layer was entirely transferred to the image-receiving sheet even though a small portion of ink had been melted. In all of these cases no satisfactory gradation was reproduced (Comparative Examples 1-3 to 1-9). A similar phenomenon was observed when the ratio of a heat-meltable dye to the binder was high even if a saturated linear polyester was used as binder (Comparative Example 1-1). As contrasted, sufficient gradation was obtained with the heat-transfer sheets according to the present first invention obtained in Examples 1-1, 1-2, and 1-3.

EXAMPLE 2 (the second invention) and COMPARATIVE EXAMPLE 2

A heat-meltable ink composition of the following formulation was coated, by means of Meyer bar, on a polyethylene terephthalate (PET) film, 9μ in thickness, which had been subjected to heat-resisting treatment, at

TABLE 1

| | | Example | | | Comparative Example | | | | | | | | |
|---|---|---|---|---|---|---|---|---|---|---|---|---|---|
| | | 1-1 | 1-2 | 1-3 | 1-1 | 1-2 | 1-3 | 1-4 | 1-5 | 1-6 | 1-7 | 1-8 | 1-9 |
| Ratio | Binder | 1 | 1 | 1 | 1 | 1 | 1 | 1 | 1 | 1 | 1 | 1 | 1 |
| | Heat-meltable dye (content in ink layer) | 1 (50%) | 0.7 (41.2%) | 2.6 (72.2%) | 2.8 (73.7%) | 0.6 (37.5%) | 1 | 1 | 1 | 1 | 1 | 1 | 1 |
| Pulse width (msec.) | 1.0 | 0.27 | 0.23 | 0.38 | 0.30 | 0.21 | 0.26 | 0.30 | 0.29 | 0.98 | 0.99 | 0.31 | 0.99 |
| | 1.2 | 0.42 | 0.30 | 0.49 | 0.91 | 0.23 | 0.37 | 0.31 | 0.31 | 1.21 | 1.20 | 0.44 | 1.21 |
| | 1.4 | 0.59 | 0.38 | 0.69 | 1.20 | 0.31 | 0.41 | 1.21 | 0.33 | 1.21 | 1.22 | 1.20 | 1.22 |
| | 1.6 | 0.74 | 0.47 | 0.94 | 1.24 | 0.35 | 1.20 | 1.21 | 1.22 | 1.21 | 1.22 | 1.21 | 1.22 |
| | 1.8 | 0.90 | 0.56 | 1.12 | 1.27 | 0.38 | 1.20 | 1.21 | 1.22 | 1.21 | 1.22 | 1.22 | 1.22 |
| | 2.0 | 1.01 | 0.68 | 1.22 | 1.29 | 0.41 | 1.20 | 1.21 | 1.22 | 1.21 | 1.22 | 1.22 | 1.22 |
| | 2.2 | 1.09 | 0.80 | 1.26 | 1.31 | 0.45 | 1.20 | 1.21 | 1.22 | 1.21 | 1.22 | 1.22 | 1.22 |
| | 2.4 | 1.15 | 0.89 | 1.28 | 1.33 | 0.51 | 1.21 | 1.22 | 1.23 | 1.21 | 1.22 | 1.22 | 1.22 |
| | 2.6 | 1.18 | 0.96 | 1.29 | 1.33 | 0.55 | 1.21 | 1.22 | 1.23 | 1.21 | 1.22 | 1.22 | 1.22 |
| | 2.8 | 1.22 | 1.00 | 1.30 | 1.33 | 0.57 | 1.21 | 1.22 | 1.23 | 1.21 | 1.22 | 1.22 | 1.22 |
| | 3.0 | 1.22 | 1.02 | 1.30 | 1.33 | 0.58 | 1.21 | 1.23 | 1.23 | 1.22 | 1.23 | 1.23 | 1.23 |

Note:
The binder used in Examples 1-1, 1-2, and 1-3 and in Comparative Examples 1-1 and 1-2 was a saturated linear polyester, Vylon-630.

a coverage of 4 g/m² on dry basis to obtain a heat-transfer recording sheet (donar sheet) of Example 2-1.

| | Parts by weight |
|---|---|
| SOT Blue G (Hodogaya Chemical Co., m.p. 74–75° C.) | 10 |
| Paraffin wax, 150° F. | 40 |
| Polyvinyl alcohol | 20 |
| Lauryl gallate (m.p. 96° C.) | 30 |

The ink coating was applied as a 20-% dispersion in ethanol prepared by milling the above composition and ethanol in a ball mill.

The ink-bearing surface of the donor sheet was brought into contact with a plain paper (TTR-PW, tradename, a receiving sheet for the heat-transfer recording produced by Mitsubishi Paper Mills Co.). Thermal impression was performed on the back side of the donor sheet by means of a facsimile tester (Matsushita Electronic Parts Co.) at 16.0 V, while the pulse width having been varied from 0.2 to 3.0 milliseconds at an interval of 0.2 millisecond. The density of the transferred image was tested by means of a photodensitometer (Macbeth RD 514). The results of test were as shown in Table 2.

In a manner similar to that described above, heat-transfer recording sheets (donor sheets) of Examples 2-2 and 2-3 and Comparative Examples 2-1 to 2-3 were prepared and tested. The results of test were as shown also in Table 2.

TABLE 2

| | | Example No. | | | Comparative Example No. | | |
|---|---|---|---|---|---|---|---|
| | | 2-1 | 2-2 | 2-3 | 2-1 | 2-2 | 2-3 |
| Lauryl gallate | | 30 | 5 | 50 | 0 | 4 | 60 |
| SOT Blue G | | 10 | 10 | 10 | 10 | 10 | 10 |
| Paraffin wax (150° F.) | | 40 | 65 | 20 | 70 | 66 | 10 |
| Polyvinyl alcohol | | 20 | 20 | 20 | 20 | 20 | 20 |
| Pulse width | 0.2 | 0.04 | 0.08 | 0.04 | 0.03 | 0.03 | 0.02 |
| (millisecond) | 0.4 | 0.13 | 0.14 | 0.08 | 0.25 | 0.18 | 0.05 |
| | 0.6 | 0.25 | 0.32 | 0.12 | 0.77 | 0.34 | 0.08 |
| | 0.8 | 0.36 | 0.50 | 0.18 | 1.09 | 0.61 | 0.11 |
| | 1.0 | 0.47 | 0.68 | 0.26 | 1.13 | 0.90 | 0.14 |
| | 1.2 | 0.58 | 0.84 | 0.37 | 1.15 | 1.03 | 0.19 |
| | 1.4 | 0.70 | 0.93 | 0.47 | 1.16 | 1.08 | 0.25 |
| | 1.6 | 0.81 | 0.97 | 0.60 | 1.17 | 1.12 | 0.32 |
| | 1.8 | 0.92 | 1.02 | 0.73 | 1.16 | 1.14 | 0.40 |
| | 2.0 | 0.99 | 1.05 | 0.86 | 1.17 | 1.16 | 0.54 |
| | 2.2 | 1.04 | 1.08 | 0.95 | 1.17 | 1.16 | 0.69 |
| | 2.4 | 1.08 | 1.11 | 1.03 | 1.18 | 1.17 | 0.87 |
| | 2.6 | 1.12 | 1.13 | 1.10 | 1.17 | 1.17 | 0.99 |
| | 2.8 | 1.15 | 1.15 | 1.15 | 1.17 | 1.18 | 1.06 |
| | 3.0 | 1.18 | 1.17 | 1.17 | 1.17 | 1.18 | 1.09 |

As is apparent from Table 2, the heat-transfer sheets of Examples 2-1 to 2-3 exhibited the density change with gradation, whereas those of Comparative Examples 2-1 and 2-2 showed high densities at smaller pulse widths, exhibiting no gradation. The heat-transfer sheets of Comparative Example 2-3 showed low densities in the range of smaller pulse widths exhibiting insufficient gradation.

EXAMPLE 3 (the second invention) and COMPARATIVE EXAMPLE 3

A heat-meltable ink of the following formulation for hot melt coating was applied to a PET film, 9μ in thickness, which had been subjected to heat-resisting treatment, at a coverage of 3.5 g/m² on dry basis to obtain a heat-transfer recording sheet (donor sheet).

| | Parts by weight |
|---|---|
| Carbon black | 10 |
| Paraffin wax (SP-0145, tradename, Nippon Seiro Co.) | 53 |
| Ethylene-vinyl acetate resin | 6 |
| Petroleum resin (Alcon M, tradename, Arakawa Chemical Co.) | 6 |
| Ethyl gallate (m.p. 150°–153° C.) | 25 |

The impression was made on the donor sheet in a manner similar to that in Example 2. The results of test were as shown in Table 3.

A heat-transfer sheet (donor sheet) of Comparative Example 3 was prepared in the same manner as in Example 3, except that the ethyl gallate was omitted from the ink formulation and 78 parts by weight of the paraffin wax was used. The impression test was performed as in Example 3. The results of test were as shown in Table 3.

TABLE 3

| | | Example 3 | Comparative Example 3 |
|---|---|---|---|
| Ethyl gallate | | 25 | 0 |
| Carbon black | | 10 | 10 |
| Paraffin wax | | 53 | 78 |
| Ethylene-vinyl acetate resin | | 6 | 6 |
| Petroleum resin | | 6 | 6 |
| Pulse width | | 0.08 | 0.03 |
| (millisecond) | 0.4 | 0.16 | 0.10 |
| | 0.6 | 0.29 | 0.40 |
| | 0.8 | 0.42 | 0.90 |
| | 1.0 | 0.56 | 1.35 |
| | 1.2 | 0.70 | 1.47 |
| | 1.4 | 0.86 | 1.50 |
| | 1.6 | 1.00 | 1.52 |
| | 2.0 | 1.27 | 1.52 |
| | 2.2 | 1.35 | 1.53 |
| | 2.4 | 1.42 | 1.53 |
| | 2.6 | 1.48 | 1.52 |
| | 2.8 | 1.52 | 1.53 |
| | 3.0 | 1.54 | 1.53 |

As is apparent from Table 3, the density change of the heat-transfer sheet obtained in Example 3 showed gradation, whereas the sheet obtained in Comparative Example 3 showed a high density in the region of smaller pulse width and no gradation was exhibited.

EXAMPLE 4 (the second invention) and COMPARATIVE EXAMPLE 4

A heat-meltable ink of the following formulation was applied, by means of Meyer bar to a PET film, 9μ in thickness, which had been subjected to heat-resisting treatment, at a coverage of 4 g/m² on dry basis to obtain a heat-transfer sheet (donor sheet) of Example 4-1.

| | Parts by weight |
|---|---|
| SOT Blue G (m.p. 74°–75° C., Hodogaya Chemical Co.) | 10 |
| Parrafin wax (150° F.) | 40 |
| Polyvinyl alcohol | 20 |
| Lauryl gallate (m.p. 96° C.) | 30 |
| 2,4,7,9-Tetramethyl-5-decyne-4,7-diol | 3 |

The heat-meltable ink was applied in the form of a 20-% dispersion in ethanol prepared by milling the constituents in a ball mill.

The ink-bearing surface of the donor sheet was brought into contact with a plain paper (TTR-PW, tradename, a receiving sheet for the heat-transfer sheet produced by Mitsubishi Paper Mills Co.). Thermal impression was performed on the back side of the donor sheet by means of a facsimile tester (Matsushita Electronic Parts Co.) at 16.0 V, while the pulse width having been varied from 0.2 to 3.0 milliseconds at an interval of 0.2 millisecond. The density of the transferred image was tested by means of a photodensitometer (Macbeth RD 514). The results of test were as shown in Table 4. To examine the effect of the addition of 2,4,7,9-tetramethyl-5-decyne-4,7-diol, an acetylene glycol, upon the adherence of the ink layer to the PET film, the donor sheet was subjected to the repeated folding test. No peeling of the ink layer was observed.

In a manner similar to that described above, heat-transfer recording sheets (donor sheets) of Examples 4-2 to 4-5 and Comparative Examples 4-1 to 4-3 were prepared and tested. The results were as shown in Table 4. In Table 4, the mark "o" means no peeling of the heat-meltable ink layer from the PET film and the mark "x" means the occurrence of peeling (Comparative Examples 4-1 and 4-2) or the transformation of the ink layer into a sticky semi-fluid (Comparative Example 4-3).

As is apparent from Table 4, the heat-transfer sheets of Examples 4-1 to 4-5 were found to exhibit gradation in the density change and satisfactory adherence of the ink layer to the PET film, whereas the heat-transfer sheet of Comparative Example 4-1 showed a high density of the transferred image in the range of small pulse width and the heat-transfer sheet of Comparative Example 4-2 showed peeling of the ink layer owing to a poor adherence to the PET film, though gradation was exhibited. The sheet of Comparative Example 4-3 was out usable, because the ink layer had become a sticky semi-fluid owing to an excessively high adherence to the PET film.

TABLE 4

| | | Example No. | | | | | Comparative Example No. | | |
|---|---|---|---|---|---|---|---|---|---|
| | | 4-1 | 4-2 | 4-3 | 4-4 | 4-5 | 4-1 | 4-2 | 4-3 |
| Lauryl gallate | | 30 | 5 | 50 | 30 | 5 | 0 | 30 | 30 |
| 2,4,7,9-Tetramethyl-5-decyne-4,7-diol (% in ink layer) | | 3 (2.0%) | 0.5 (0.49%) | 10 (9.09%) | 20 (20%) | 0.1 (0.1%) | 0 (0%) | 0.05 (0.04%) | 21 (23.1%) |
| SOT Blue G | | 10 | 10 | 10 | 10 | 10 | 10 | 10 | 10 |
| Parraffin wax (150° F.) | | 40 | 65 | 20 | 20 | 65 | 70 | 66 | 10 |
| Polyvinyl alcohol | | 20 | 20 | 20 | 20 | 20 | 20 | 20 | 20 |
| Pulse width (millisecond) | 0.2 | 0.04 | 0.08 | 0.04 | 0.05 | 0.05 | 0.03 | 0.04 | 0.03 |
| | 0.4 | 0.13 | 0.14 | 0.08 | 0.12 | 0.08 | 0.25 | 0.13 | 0.15 |
| | 0.6 | 0.25 | 0.32 | 0.12 | 0.22 | 0.26 | 0.77 | 0.25 | 0.30 |
| | 0.8 | 0.36 | 0.50 | 0.18 | 0.33 | 0.38 | 1.09 | 0.36 | 0.40 |
| | 1.0 | 0.47 | 0.68 | 0.26 | 0.44 | 0.53 | 1.13 | 0.47 | 0.51 |
| | 1.2 | 0.58 | 0.84 | 0.37 | 0.54 | 0.66 | 1.15 | 0.58 | 0.63 |
| | 1.4 | 0.70 | 0.93 | 0.47 | 0.65 | 0.78 | 1.16 | 0.70 | 0.72 |
| | 1.6 | 0.81 | 0.97 | 0.60 | 0.75 | 0.88 | 1.17 | 0.81 | 0.85 |
| | 1.8 | 0.92 | 1.02 | 0.73 | 0.81 | 0.96 | 1.16 | 0.92 | 0.95 |
| | 2.0 | 0.99 | 1.05 | 0.86 | 0.94 | 1.02 | 1.17 | 0.99 | 0.98 |
| | 2.2 | 1.04 | 1.08 | 0.95 | 1.01 | 1.06 | 1.17 | 1.04 | 1.04 |
| | 2.4 | 1.08 | 1.11 | 1.03 | 1.06 | 1.09 | 1.18 | 1.08 | 1.12 |
| | 2.6 | 1.12 | 1.13 | 1.10 | 1.10 | 1.12 | 1.17 | 1.12 | 1.14 |
| | 2.8 | 1.15 | 1.15 | 1.15 | 1.14 | 1.15 | 1.17 | 1.15 | 1.15 |
| | 3.0 | 1.18 | 1.17 | 1.17 | 1.16 | 1.17 | 1.17 | 1.18 | 1.15 |
| Adherence of heat-meltable ink layer to PET film | | o | o | o | o | o | x | x | x |

EXAMPLE 5 (the second invention) and COMPARATIVE EXAMPLE 5

A heat-meltable ink of the following formulation for hot melt coating was applied to a PET silm, 9μ in thickness, which had been subjected to heat-resisting treatment, at a coverage of 3.5 g/m$^2$ on dry basis to obtain a heat-transfer recording sheet (donor sheet).

| | Parts by weight |
|---|---|
| Carbon black | 10 |
| Paraffin wax (SP-0145, tradename, Nippon Seiro Co.) | 53 |
| Ethylene-vinyl acetate resin | 6 |
| Petroleum resin (Alcon M, tradename, Arakawa Chemical Co.) | 6 |
| Ethyl gallate (m.p. 150°-153° C.) | 25 |
| 3,6-Dimethyl-4-octyne-3,6-diol | 5 |

The impression test was performed on the donor sheet in a manner similar to that in Example 4. The results of test were as shown in Table 5.

In Comparative Example 5, a heat-transfer recording sheet (donor sheet) was prepared in the same manner as in Example 5, except that ethyl gallate was omitted from the heat-meltable ink formulation and 78 parts by weight of paraffin wax was used. The impression test was carried out at in Example 5. The results of test were as shown in Table 5.

As is apparent from Table 5, the heat-transfer recording sheet of Example 5 showed the density change with gradation and satisfactory adherence of the ink layer to the PET film, whereas that of Comparative Example 5 showed high densities in the region of small pulse widths and the density change showed no gradation.

TABLE 5

| | Example 5 | Comparative Example 5 |
|---|---|---|
| Ethyl gallate | 25 | 0 |
| 3,6-Dimethyl-4-octyne-3,6-diol | 5 | 5 |

TABLE 5-continued

| | | Example 5 | Comparative Example 5 |
|---|---|---|---|
| Carbon black | | 10 | 10 |
| Paraffin wax | | 53 | 78 |
| Ethylene-vinyl acetate resin | | 6 | 6 |
| Petroleum resin | | 6 | 6 |
| Pulse width (millisecond) | 0.2 | 0.08 | 0.03 |
| | 0.4 | 0.16 | 0.10 |
| | 0.6 | 0.29 | 0.40 |
| | 0.8 | 0.42 | 0.90 |
| | 1.0 | 0.56 | 1.35 |
| | 1.2 | 0.70 | 1.47 |
| | 1.4 | 0.86 | 1.50 |
| | 1.6 | 1.00 | 1.52 |
| | 1.8 | 1.15 | 1.52 |
| | 2.0 | 1.27 | 1.52 |
| | 2.2 | 1.35 | 1.53 |
| | 2.4 | 1.42 | 1.53 |
| | 2.6 | 1.48 | 1.52 |
| | 2.8 | 1.52 | 1.53 |
| | 3.0 | 1.54 | 1.53 |
| Adherence of ink layer to PET film | | o | o |

What is claimed is:

1. A gradation recording heat-transfer sheet comprising a support and, provided thereon, a heat-meltable ink layer containing a heat-meltable dye, which is characterized by being such that said heat-meltable ink layer further contains a saturated linear polyester; said heat-meltable dye has a melting point of 60°–120° C.; said heat-meltable dye content of said heat-meltable ink layer is 41–73% by weight in terms of solids based on total weight of the heat-meltable ink layer; and the ratio of said heat-meltable dye to said saturated linear polyester is 0.7–2.6:1.

2. A heat-transfer sheet according to claim 1, wherein the heat-meltable ink layer further contains gallic acid and/or a derivative thereof.

3. A heat-transfer sheet according to claim 2, wherein the heat-meltable ink layer further contains an acetylene glycol.

4. A heat-transfer sheet according to claim 1, wherein the heat-meltable dyes include at least yellow, magenta, and cyan dyes and the heat-meltable ink layers containing these dyes are coated in a localized pattern on the same support.

5. A heat-transfer sheet according to claim 1, wherein the heat-meltable dyes include at least yellow, magenta, cyan, and black dyes and the heat-meltable ink layers containing these dyes are coated in a localized pattern on the same support.

6. A gradation recording heat-transfer sheet comprising a support and, provided thereon, a heat-meltable ink layer containing a colored dye and/or a pigment, a non-wax binder, a saturated linear polyester, and a wax, which is characterized by being such that said heat-meltable ink layer further contains galllic acid and/or at least one derivative of gallic acid selected from methyl gallate, ethyl gallate, propyl gallate, isoamyl gallate, octyl gallate, lauryl gallate, stearyl gallate, trimethoxygallic acid, methyl trimethoxygallate, gallic acid 3-methyl ether, gallic acid 4-methyl ether, gallic acid 3,4-dimethyl ether, and gallic acid 3,5-dimethyl ether in an amount of 5–50% by weight in terms of solids based on the total weight 9 of the heat-meltable ink layer, and an acetylene glycol in an amount of 0.1–20% by weight in terms of solids based on the total weight of the heat-meltable ink layer.

7. A heat-transfer sheet according to claim 6, wherein the acetylene glycol is at least one compound selected from 2,4,7,9-tetramethyl-5-decyne-4,7-diol, an ethylene oxide adduct thereof, and 3,6-dimethyl-4-octyne-3,6-diol.

8. A heat transfer sheet according to claim 6, wherein the ink layer further contains ethyl gallate or lauryl gallate.

* * * * *